US011078699B2

(12) United States Patent
Gasser

(10) Patent No.: US 11,078,699 B2
(45) Date of Patent: Aug. 3, 2021

(54) FURNITURE HINGE

(71) Applicant: Julius Blum GmbH, Hoechst (AT)

(72) Inventor: Ingo Gasser, Hoechst (AT)

(73) Assignee: Julius Blum GmbH, Hoechst (AT)

( * ) Notice: Subject to any disclaimer, the term of this patent is extended or adjusted under 35 U.S.C. 154(b) by 33 days.

(21) Appl. No.: 16/668,236

(22) Filed: Oct. 30, 2019

(65) Prior Publication Data

US 2020/0063480 A1 Feb. 27, 2020

Related U.S. Application Data

(63) Continuation of application No. PCT/AT2018/000037, filed on May 4, 2018.

(30) Foreign Application Priority Data

May 11, 2017 (AT) ..... A 50396/2017

(51) Int. Cl.
*E05D 7/04* (2006.01)
*E05D 5/04* (2006.01)

(52) U.S. Cl.
CPC ..... *E05D 7/04* (2013.01); *E05D 5/046* (2013.01); *E05D 2007/0461* (2013.01); *E05Y 2900/20* (2013.01)

(58) Field of Classification Search
CPC ..... E05D 7/04; E05D 7/0415; E05D 7/0027; E05D 7/0045; E05D 7/0009; E05D 3/02;
(Continued)

(56) References Cited

U.S. PATENT DOCUMENTS 994,196 A 6/1911 Reddick
2,583,950 A * 1/1952 Kirschner ..... E05D 7/0423 16/238

(Continued)

FOREIGN PATENT DOCUMENTS

AT 001 787 11/1997
CN 2595961 12/2003

(Continued)

OTHER PUBLICATIONS

Search Report dated Aug. 31, 2020 in corresponding Chinese Patent Application No. 201880030480.2.

(Continued)

*Primary Examiner* — Chuck Y Mah
(74) *Attorney, Agent, or Firm* — Wenderoth, Lind & Ponack, L.L.P.

(57) ABSTRACT

A furniture hinge includes a first fitting portion and a second fitting portion, the second fitting portion being pivotally connected to the first fitting portion by a hinge axis member. At least one of the fitting portions includes a base plate to be fixed to a furniture part, and an adjusting plate coupled to the hinge axis member, the adjusting plate being displaceably arranged on the base plate. A preferably pivotally mounted adjustment element can adjust a position of the adjusting plate relative to the base plate along a linear guide to adjust a position of the first fitting portion relative to the second fitting portion. A gap is formed between the first fitting portion and the second fitting portion in at least one relative position of the furniture hinge, and the adjustment element can be actuated by introducing a tool into the gap.

27 Claims, 5 Drawing Sheets

(58) Field of Classification Search
CPC ..... E05D 5/02; E05D 5/0207; E05D 5/0215; E05D 5/0223; E05D 5/023; E05D 5/043; E05D 5/046; E05D 11/0054; E05D 2007/0036; E05D 2007/0461; E05D 2007/0469; E05D 2007/0492; E05Y 2600/10; E05Y 2600/502; E05Y 2900/132; E05Y 2900/148; E05Y 2900/532; E05Y 2900/546; E05Y 2600/12; E05Y 2600/31; E05Y 2600/51; E05Y 2600/526; E05Y 2600/54; E05Y 2600/61; E05Y 2900/622; E05Y 2900/20; Y10T 16/554; Y10T 16/534; Y10T 16/5358; Y10T 16/5321; Y10T 16/5322; Y10T 16/53225; Y10T 16/53235; Y10T 16/53247; Y10T 16/53253; E06B 2009/007; B62D 65/06
See application file for complete search history.

(56) References Cited

U.S. PATENT DOCUMENTS 2,839,778 A * 6/1958 Hutchinson ..... E05D 7/0423 16/245
2,854,687 A * 10/1958 Baldauf ..... E05D 7/0423 16/236
3,596,307 A * 8/1971 Kolmetsky ..... E05D 7/0423 16/237
5,144,721 A 9/1992 Schade
5,713,105 A * 2/1998 Toomey ..... E05D 7/0423 16/238
5,806,144 A * 9/1998 Fries ..... E05D 7/0423 16/246
5,930,866 A 8/1999 Rupprechter
6,141,830 A * 11/2000 Shimooka ..... E05D 7/0423 16/237
6,647,591 B1 11/2003 Domenig et al.
7,870,642 B1 * 1/2011 Finkelstein ..... E05D 7/0423 16/260
8,020,253 B1 * 9/2011 Finkelstein ..... E05D 11/0054 16/250
8,429,794 B2 * 4/2013 Tagtow ..... E05D 7/0423 16/238
8,720,008 B2 * 5/2014 Dodge ..... G16H 20/10 16/245
9,284,761 B2 3/2016 Haab et al.
9,487,980 B2 * 11/2016 Pelekanos ..... E05D 11/0054
9,493,973 B2 * 11/2016 Mitchell ..... E05D 7/0423
9,546,509 B2 1/2017 Siekierka et al.
9,624,705 B2 4/2017 Haab et al.
9,644,410 B2 * 5/2017 Hayes ..... E05D 3/02
9,644,411 B2 * 5/2017 Gompper ..... E05D 7/04
10,494,112 B2 * 12/2019 Gonzalez Prieto .... B64D 29/06
2001/0025396 A1 * 10/2001 Sitter ..... E05D 7/0415 16/221
2004/0128794 A1 * 7/2004 Chung ..... E05D 7/0423 16/236
2006/0260096 A1 11/2006 Fries
2007/0157430 A1 7/2007 Lautenschlager
2011/0296652 A1 * 12/2011 Zhang ..... E05D 11/04 16/239
2012/0102674 A1 * 5/2012 King ..... E05D 11/04 16/237
2014/0082887 A1 3/2014 Siekierka et al.
2014/0150208 A1 6/2014 Haab et al.
2014/0259527 A1 * 9/2014 Chung ..... E05D 7/0415 16/238
2016/0201368 A1 7/2016 Haab et al.
2016/0201369 A1 * 7/2016 Criddle ..... E05D 7/0045 16/238
2017/0146282 A1 * 5/2017 Dodge ..... E05D 7/0415

FOREIGN PATENT DOCUMENTS

CN 101387174 3/2009
CN 101839100 9/2010
CN 202090745 12/2011
DE 298 16 601 2/1999
DE 10203228 C1 * 1/2003 ..... E05D 7/0423
DE 10 2004 006 330 8/2005
DE 20 2011 101 342 10/2012
EP 1 722 056 11/2006
EP 1223275 B1 * 11/2011 ..... E05D 7/0423
EP 2 458 122 5/2012
EP 2 740 870 6/2014
EP 3 103 948 12/2016
JP 8-42234 2/1996
JP 9-96159 4/1997
JP 2002349118 A * 12/2002
JP 2003013656 A * 1/2003
JP 2004-324059 11/2004
JP 2010275710 A * 12/2010

OTHER PUBLICATIONS

International Search Report dated Sep. 18, 2018 in International (PCT) Application No. PCT/AT2018/000037.
English translation of Search Report dated Apr. 29, 2019 in Taiwanese Application No. 107115921.
Search Report dated Apr. 23, 2021 in Chinese Application No. 201880030480.0.

* cited by examiner

FURNITURE HINGE

BACKGROUND OF THE INVENTION

The present invention relates to a furniture hinge for pivotally connecting a first furniture part to a second furniture part. The furniture hinge Includes a first fitting portion to be fixed to the first furniture part, and a second fitting portion to be fixed to the second furniture part, the second furniture part being pivotally connected to the first fitting portion by at least one hinge axis member. At least one of the fitting portions includes a base plate to be fixed to one of the furniture parts and an adjusting plate coupled to the hinge axis member, and the adjusting plate is displaceably arranged relative to the base plate. A preferably pivotally mounted adjustment element is provided, and by an actuation of the adjustment element, a position of the adjusting plate can be adjusted relative to the base plate along at least one linear guide, so that a position of the first fitting portion relative to the second fitting portion can be adjusted.

The invention further concerns an arrangement comprising a first furniture part, a second furniture part and a furniture hinge for pivotally connecting the first furniture part to the second furniture part.

The invention further relates to an item of furniture comprising at least one furniture hinge of the described type, or an arrangement of the aforementioned type.

EP 2 740 870 A1 discloses a guide device for door wings, and each of the door wings are displaceably and pivotally supported relative to a furniture carcass in a mounted condition. The two door wings are thereby pivotally connected by a hinge fitting (FIG. 10a-10c), and the hinge fitting includes two hinges connected to one another by a joint shaft. In order to ensure a proper movement of the door wings in the mounted condition, the hinge fitting needs to be exactly positioned to the door wings, which is frequently difficult to accomplish in practice. Due to a possible warping of the furniture parts, a gap formed between the furniture parts can vary, which is, on the one hand, optically not very attractive. On the other hand, this can lead to the fact that the door wings can no longer be duly closed.

U.S. Pat. No. 6,647,591, DE 20 2011 101 342 U1, U.S. Pat. No. 994,196 and AT 1787 U1 disclose furniture hinges for pivotally connecting furniture parts, and a position of the door wings relative to one another can be adjusted in at least one linear direction by rotating a pivotally mounted adjustment element. A drawback is the fact that the furniture part, in the mounted condition, has to be moved into an open position, so that the adjustment element is accessible for a tool-assisted actuation. Accordingly, in order for adjusting the furniture parts to one another, the furniture part must firstly be opened, and the adjustment element of the furniture hinge has to be actuated by a tool. Subsequently, the furniture part is again closed and it is necessary for a person to inspect whether the furniture parts are, in fact, optimally aligned to one another as a result of the previously performed adjustment. Depending on the mounting situation and depending on the experience of the assembling person, this cycle must be repeated several times, which can be time-consuming and annoying.

SUMMARY OF THE INVENTION

It is an object of the present invention to propose a furniture hinge of the type mentioned in the introductory part, thereby avoiding the drawbacks as discussed above.

According to the invention, a gap is formed between the first fitting portion and the second fitting portion in at least one relative position of the furniture hinge, wherein the at least one adjustment element can be actuated by introducing a tool, preferably a screwdriver, into the gap.

The furniture hinge according to the invention allows a comfortable adjustment through the gap formed between the furniture parts, wherein a change of the relative position of the furniture parts to one another, caused by a performed actuation of the at least one adjustment element, is immediately apparent for the assembling person. This allows an intuitive and, in particular, a quickly implemented adjustment, without the necessity that the furniture parts must be opened and closed several times.

In this way, the two furniture parts can be adjusted relative to one another in the mounted condition of the furniture hinge, preferably at least in a two-dimensional manner, in a lateral direction and/or in a height direction and/or in a depth direction relative to one another, so that the two furniture parts—for correcting a conical gap formed between the two furniture parts—can be aligned in a parallel relationship to one another and/or a height position and/or a depth position of the two furniture parts can be aligned to one another. The adjustment in the lateral direction, in the height direction and in the depth direction occur independently from one another, i.e. that the mentioned adjustments do not mutually influence each other.

Thereby, the at least one adjustment element can be actuated by the tool introduced into the gap in a relative position of the furniture hinge, in which the fitting portions or the furniture parts connected to the fitting portions in the mounting condition adopt an angle of between 0° and 125°, preferably between 0° and 90°, to one another.

According to an embodiment, the at least one adjustment element is pivotally mounted about a pivoting axis, wherein the pivoting axis of the at least one adjustment element extends transversely, preferably substantially at a right angle, relative to the hinge axis member of the furniture hinge.

Furthermore, the at least one adjustment element includes a first end having a tool receiving device for receiving a tool, preferably a screwdriver, and a second end spaced from the first end in the longitudinal direction of the adjustment element, wherein the first end of the adjustment element is arranged closer to the gap than the second end.

According to an embodiment, the linear guide can include at least one elongated hole arranged in the base plate or in the adjusting plate, and a guide element arranged on the adjusting plate or on the base plate is configured to be displaced along the elongated hole. As an alternative or in addition thereto, it can be provided that the linear guide includes at least one guide edge (for example in the form of a bending edge or an embossing) arranged on the base plate for the displaceable support of the adjusting plate. It may also be the case that two or more linear guides are provided by which the adjusting plate can be displaceably guided relative to the base plate. In this way, the adjusting plate is held in a tilt-proof manner relative to the base plate, and the adjustments can be performed along a precise linear adjustment path.

By an actuation of the adjusting element, in the mounted condition of the furniture hinge, a lateral distance between the first fitting portion and the second fitting portion can be adjusted. Moreover, at least one second adjusting element can be provided, and by an actuation of the second adjusting element in the mounted condition of the furniture hinge, a height position of the first fitting portion relative to the second fitting portion can be adjusted. Moreover, a third adjusting element can be provided, and by an actuation of the third adjusting element, a depth position of the fitting portions can be adjusted relative to one another.

At least one of the adjustment elements can also be, for example, displaceably supported, and the adjustment element can be positioned on predetermined locations, for example by the arrangement of detents.

Alternatively, the first adjusting element and/or the second adjusting element and/or the third adjusting element is or are rotatably supported. In this connection, it can be provided that the first adjusting element has a first rotational axis and that the second adjusting element has a second rotational axis, wherein a direction of the first rotational axis and a direction of the second rotational axis extend substantially parallel to one another. In this way, a very compact adjustment possibility can be provided, because the access for a person for rotating the adjusting elements can be executed from the same side of the fitting portion. A very compact and flat configuration of the fitting portion is then provided if a direction of the first pivoting axis and a direction of the second pivoting axis and/or a direction of the third pivoting axis, in at least one relative position of the furniture hinge, extend substantially parallel to one another, or extend within an angle of between 10° and 50° relative to a main plane formed by the base plate.

At least one of the adjusting elements can be configured, for example, as a hand wheel configured to be manually actuated. As an alternative thereto, it is possible that a tool receiving device for torque transmission is provided, and the adjusting plate is configured to be adjusted relative to the base plate by exerting a torque to the tool receiving device with the aid of a tool.

BRIEF DESCRIPTION OF THE DRAWINGS

Further details and advantages of the present invention result from the following description of figures, in which.

DETAILED DESCRIPTION OF THE INVENTION

Figure 1A:
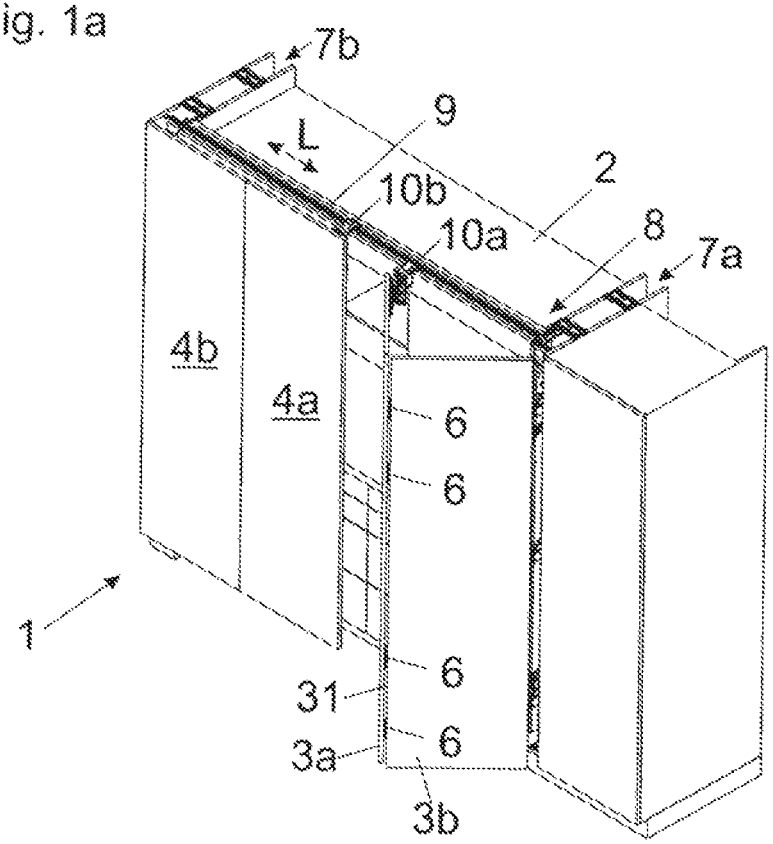
FIG. 1*a*, 1*b* show an item of furniture having a first furniture part and a second furniture part being in an open position and in a closed position.

FIG. 1*a* shows an item of furniture 1 having a furniture carcass 2, and each of a first furniture part 3*a* and a second furniture part 3*b* are movably supported relative to the furniture carcass 2. The first furniture part 3*a* and the second furniture part 3*b* are pivotally connected to one another by at least one furniture hinge 6. However, two or more furniture hinges 6 can also be arranged for pivotally connecting the furniture parts 3*a*, 3*b*. Furniture hinges 6 which are configured for pivotally connecting two movably supported furniture parts 3*a*, 3*b* are frequently referred to as middle hinges. Moreover, two further furniture parts 4*a*, 4*b* may also be provided, and the furniture parts 4*a*, 4*b* are also pivotally connected to one another by furniture hinges 6. A vertically extending gap 31 is formed between the first furniture part 3*a* and the second furniture part 3*b*, the first furniture part 3*a* and the second furniture part 3*b* being connected to one another by the furniture hinges 6. At least one, preferably all, adjusting elements 16*a*, 16*b*, 16*c* (see FIG. 2) can be actuated, in at least one relative position of the furniture hinge 6, by introducing a screwdriver into the gap 31 for adjusting a relative position of the two furniture parts 3*a*, 3*b* to one another.

Figure 1B:
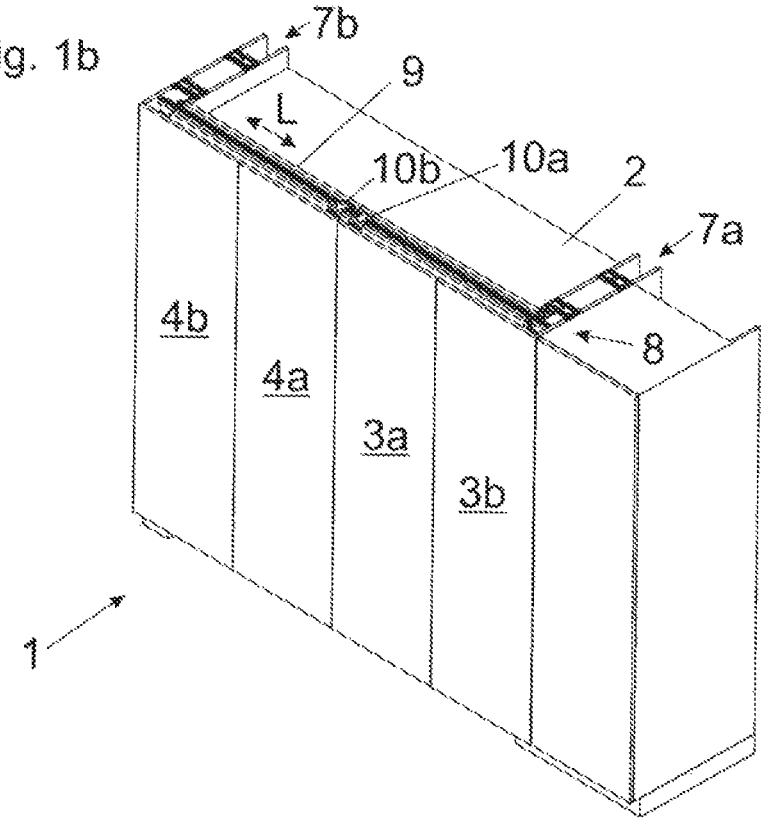

The furniture parts 3*a*, 3*b* and 4*a*, 4*b* are movably supported relative to the furniture carcass 2 by a guide system 8. In the shown embodiment, the furniture parts 3*a*, 3*b*; 4*a*, 4*b* are movably supported by the guide system 8 between a first position, in which the furniture parts 3*a*, 3*b*; 4*a*, 4*b* are aligned substantially parallel to one another, and a second position, in which the furniture parts 3*a*, 3*b*; 4*a*, 4*b* are aligned substantially coplanar to one another (see FIG. 1). In the first position, in which the furniture parts 3*a*, 3*b*; 4*a*, 4*b* are aligned parallel to one another, the furniture parts 3*a*, 3*b*; 4*a*, 4*b* can be inserted in pairs into a cavity 7*a*, 7*b* arranged laterally besides the furniture carcass 2. The guide system 8 includes a first guide rail 9 having a longitudinal direction (L) for guiding the furniture parts 3*a*, 3*b*; 4*a*, 4*b*. The guide system 8 further includes at least one second guide rail (not shown here), the second guide rail extending at a right angle relative to the longitudinal direction (L) of the first guide rail 9 in the mounted condition and by which each of the furniture parts 3*a*, 3*b*; 4*a*, 4*b* can be inserted into and extended from the lateral cavities 7*a*, 7*b*. The furniture part 3*a* is connected to a guiding device 10*a* configured to be moved along the first guide rail 9. The furniture part 4*a*, on the contrary, is connected to a further guiding device 10*b* which can also configured to be displaced along the first guide rail 9. FIG. 1*b* shows the furniture parts 3*a*, 3*b*; 4*a*, 4*b* in a closed position in which the furniture parts 3*a*, 3*b*; 4*a*, 4*b* are aligned coplanar relative to one another.

Figure 2:
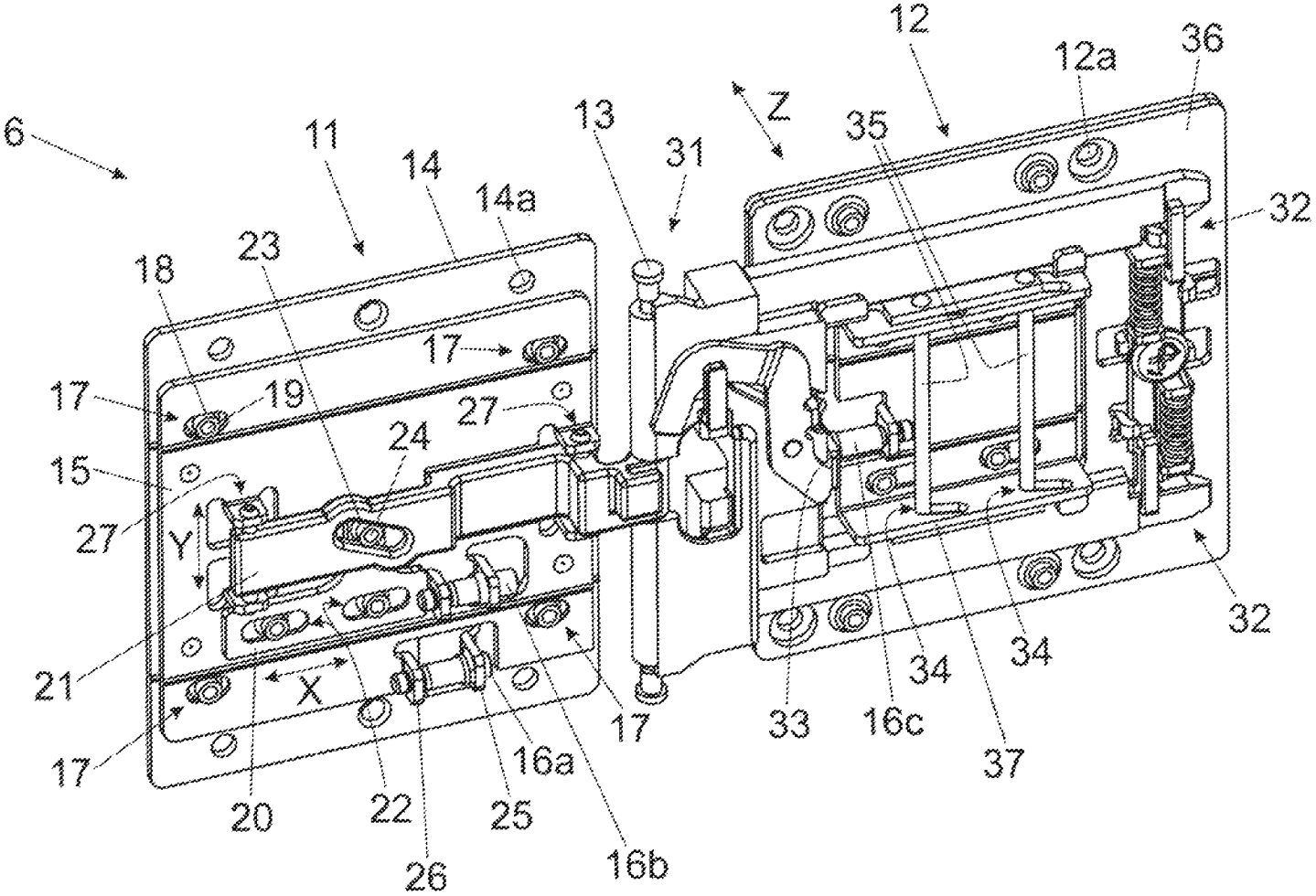
FIG. 2 shows a possible embodiment of a furniture hinge in a perspective view.

FIG. 2 shows a perspective view of a furniture hinge 6 for pivotally connecting the first furniture part 3*a* to the second furniture part 3*b*. The furniture hinge 6 includes a first fitting portion 11 to be fixed to the first furniture part 3*a*, and a second fitting portion 12 to be fixed to the second furniture part 3*b*. The first fitting portion 11 and the second fitting portion 12 are pivotally connected to one another by at least one hinge axis member 13 or can be configured to be releasably connected to one another by at least one locking device 32. The first fitting portion 11 includes at least one fastening location 14*a*, preferably an opening for the passage of screws, for fixing to the first furniture part 3*a*. The second fitting portion 12 also includes at least one fastening location 12*a*, for example an opening for the passage of screws, for fixing to the second furniture part 3*b*.

In the shown embodiment, the first fitting portion 11 includes a base plate 14 to be fixed to the first furniture part 3*a*, the base plate 14 being configured to be mounted to the first furniture part 3*a* by the at least one fastening location 14*a*. Moreover, an adjusting plate 15 is provided, the adjusting plate 15 being configured to be displaced relative to the base plate 14. For the displaceable support of the adjusting plate 15 in a direction (X), at least one linear guide 17 is provided. For example, the linear guide 17 can include an elongated hole 18 arranged on the adjusting plate 15, and a guide element 19 arranged on the base plate 14 can be displaceably guided along the elongated hole 18. In a mechanical reversal, it is also possible that the base plate 14 has the elongated hole 18 in which a guide element 19 arranged on the adjusting plate 15 can be displaceably guided. In the shown figure, a plurality of such linear guides 17 is provided for the displaceably support of the adjusting plate 15. A bearing 25 for receiving an adjustment element

16*a* is formed on the base plate 14, the adjustment element 16*a* being in threading engagement with a counter-bearing 26 arranged on the adjusting plate 15. Accordingly, by rotating the first adjustment element 16*a*, the adjusting plate 15 can be adjusted along the linear guides 17 in a direction (X), so that the lateral distance of the fitting portions 11, 12 (and therewith the distance of the furniture parts 3*a*, 3*b*) can be adjusted relative to one another.

Moreover, a carrier plate 21 is movably mounted on the adjusting plate 15, and by rotating a second adjustment element 16*b*, a height position of the carrier plate 21 can be adjusted relative to the adjusting plate 15, and the carrier plate 21 being coupled to the hinge axis member 13. For the displaceable support of the carrier plate 21 in a direction (Y), second linear guides 27 are provided. The carrier plate 21 includes at least one inclinedly extending guide 23 along which at least one guide portion 24 can be displaceably guided by rotating the second adjustment element 16*b*. By rotating the second adjustment element 16*b*, a slider 20 can be displaced along guides 22 in the direction (X), whereby the guide portion 24 arranged on the slider 20 displaces the carrier plate 21 in a vertical direction (Y) due to the co-operation with the inclinedly extending guide 23, so that a height position of the fitting portions 11, 12 (and therewith a height position of the furniture parts 3*a*, 3*b*) can be adjusted relative to one another. By rotating the second adjustment element 16*b* in first rotation direction, the carrier plate 21 can be lifted relative to the adjusting plate 15 in the direction (Y). By rotating the second adjustment element 16*b* in a second rotation direction, the carrier plate 21 can be lowered relative to the adjusting plate 15 in the direction (Y).

It is visible that the rotational axis of the first adjustment element 16*a* and the rotational axis of the second adjustment element 16*b* extend parallel to one another, so that the two adjustment elements 16*a*, 16*b* are accessible for a person from the same side so as to adjust the adjusting plate 15 in the lateral direction (X) and to adjust the carrier plate 21 in the vertical direction (Y). As a result, a very comfortable adjustment possibility is provided. Moreover, in the shown embodiment, each of the rotational axes of the adjustment elements 16*a*, 16*b* extend parallel to a plane formed by the base plate 14, whereby a construction of the first fitting portion 11 can be configured so as to be very compact and flat.

Moreover, a third adjustment element 16*c* is movably supported on the second fitting portion 12, and by an actuation of the third adjustment element 16*c*, a depth position of the first fitting portion 11 relative to the second fitting portion 12 can be adjusted in a direction (Z). The third adjustment element 16*c* is rotationally supported on a bearing 33 of the base plate 36 of the second fitting portion 12, and the third adjustment element 16*c* is in threading engagement with a movable adjusting plate 37. By rotating the third adjustment element 16*c*, the adjusting plate 37 can be displaceably supported relative to the base plate 36 by third linear guides 34. Here, the linear guides 34 include guiding rods 35 which are fixed to the base plate 36 of the second fitting portion 12. These guiding rods 35 engage into transversely extending elongated holes of the adjusting plate 37. Accordingly, by rotating the third adjustment element 16*c*, the adjusting plate 37 is displaced relative to the stationary guiding rods 35 and, as a result, a depth adjustment of the fitting portions 11, 12 in a direction (Z) can be set. The rotational axis of the third adjustment element 16*c*, in at least one relative position of the furniture hinge 6, extends parallel to the rotational axes of the first and second adjustment elements 16*a*, 16*b*, so that all three adjustment elements 16*a*, 16*b*, 16*c* are accessible for an actuation from the same side, in particular by introducing a tool into the gap 31 shown in FIG. 1*a*.

Figure 3A:
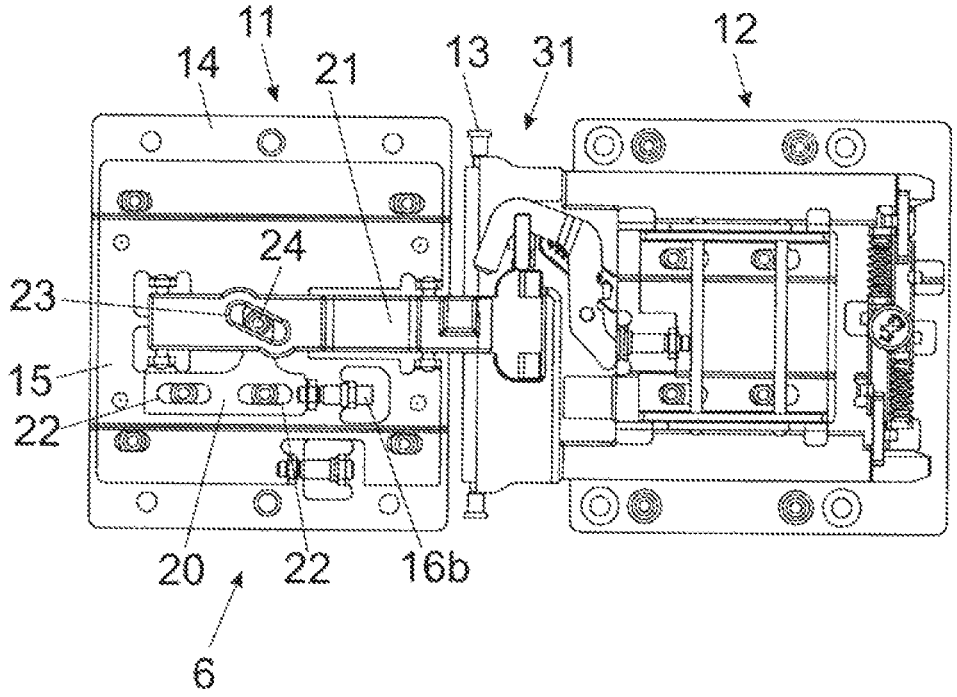
FIG. 3*a*, 3*b* show a height adjustment of the fitting portions to one another.
Figure 3B:
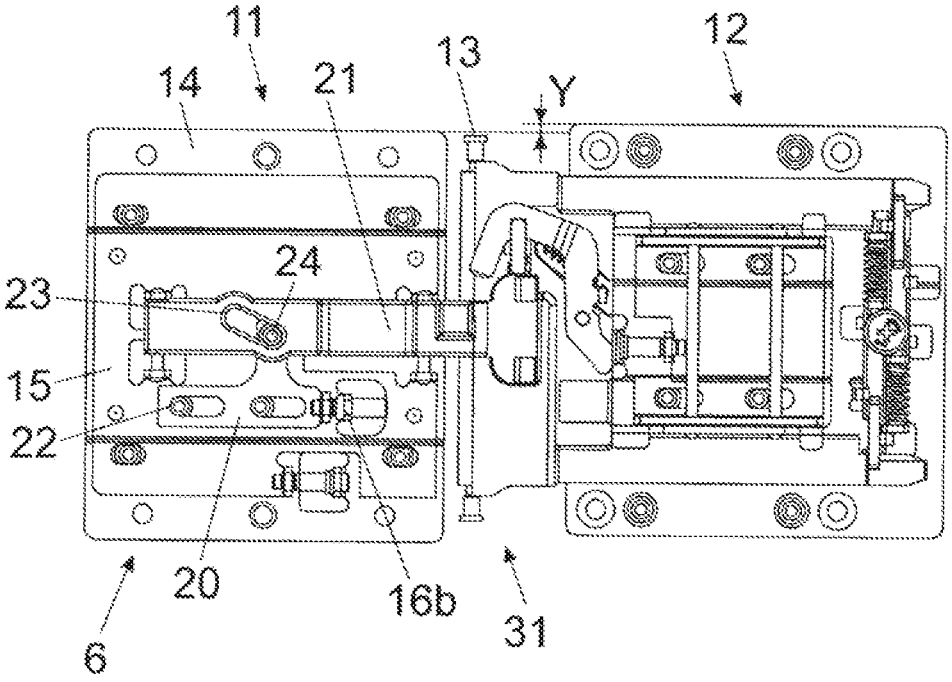

FIG. 3*a* and FIG. 3*b* show a height adjustment of the two fitting portions 11, 12 to one another. Starting from an intermediate setting according to FIG. 3*a*, in which the two fitting portions 11, 12 have an identical height position, the slider 20 can be displaced along the guides 22 in a horizontal direction by rotating the second adjustment element 16*b*, whereby the guide portion 24 arranged on the slider 20, due to the cooperation with the transversely extending guide 23, displaces the carrier plate 21 in a vertical direction (Y) by rotating the second adjustment element 16*b*. In FIG. 3*b*, the guide portion 24 adopts a lowered position relative to the transversely extending guide 23 of the carrier plate 21, and the second fitting portion 12 adopts an elevated position relative to the first fitting portion 11 in a vertical direction (Y). By rotating the second adjustment element 16*b* in an opposite rotation direction, the guide portion 24 can adopt the other end position in the transversely extending guide 23, so that the second fitting portion 12 adopts a lowered position relative to the first fitting portion 11 in the vertical direction (Y).

Figure 4A:
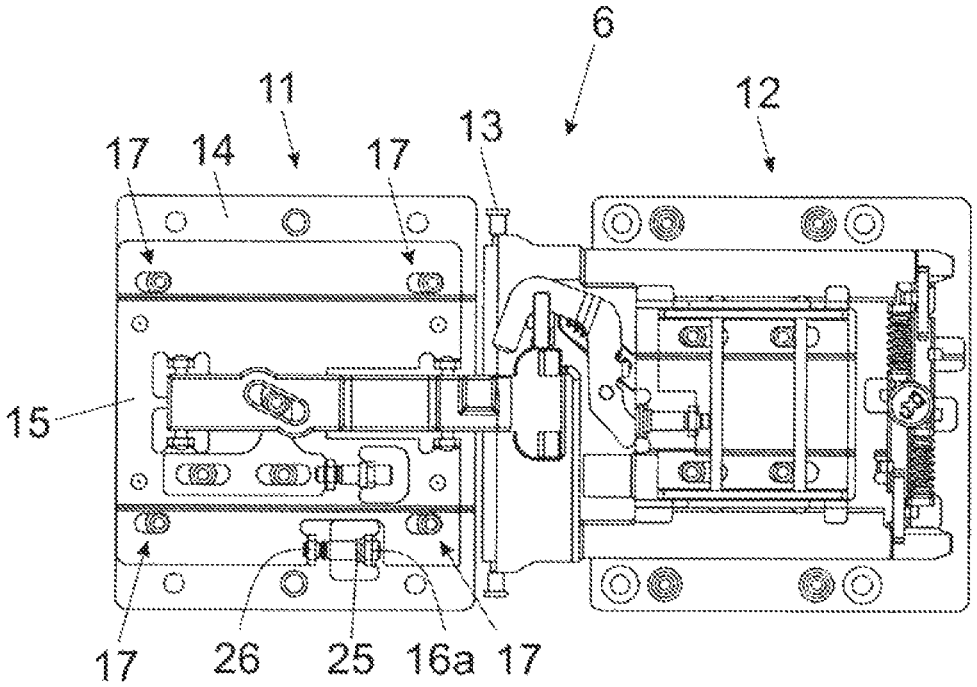
FIG. 4*a*, 4*b* show a lateral adjustment of the fitting portions to one another.
Figure 4B:
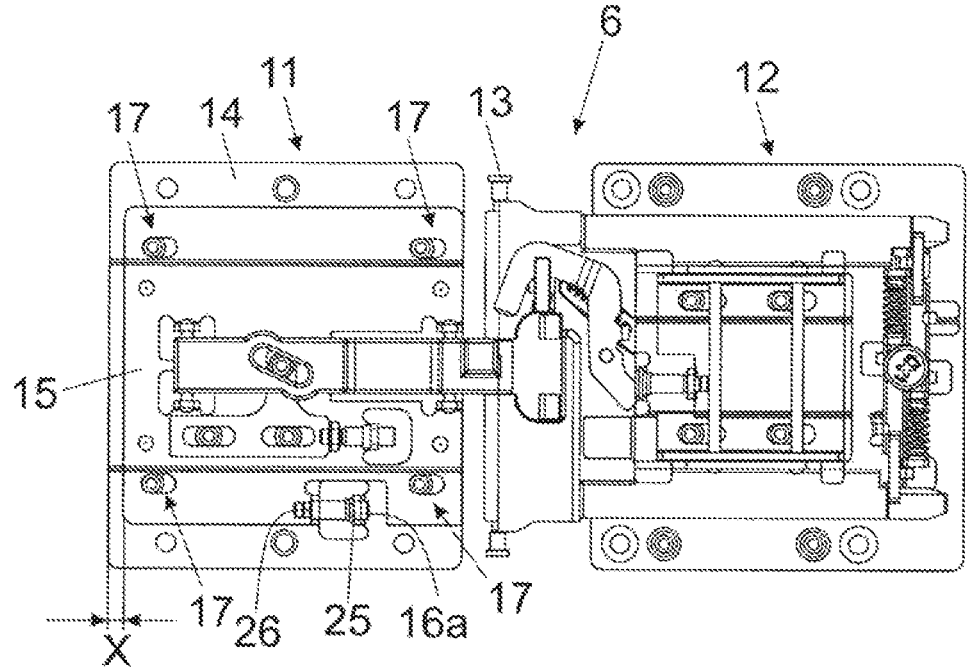

FIG. 4*a* and FIG. 4*b* show a lateral adjustment of the two fitting portions 11 and 12 to one another. Starting from the position of the adjusting plate 15 relative to the base plate 14 according to FIG. 4*a*, the adjusting plate 15 can be adjusted in a lateral direction (X) by rotating the first adjustment element 16*a*, the first adjustment element 16*a* being arranged on a bearing 25 on the base plate 14 and is in threading engagement with a counter-bearing 26 of the adjusting plate 15, so that the guide elements 19 (FIG. 2) arranged on the base plate 15 of the linear guides 17 are located on the other end of the elongated holes 18 (FIG. 2) of the linear guides 17. In FIG. 4*b*, the adjusting plate 15 is displaced by a lateral extent in the direction (X), so that the lateral distance between the two fitting portions 11, 12 to one another is enlarged.

Figure 5:
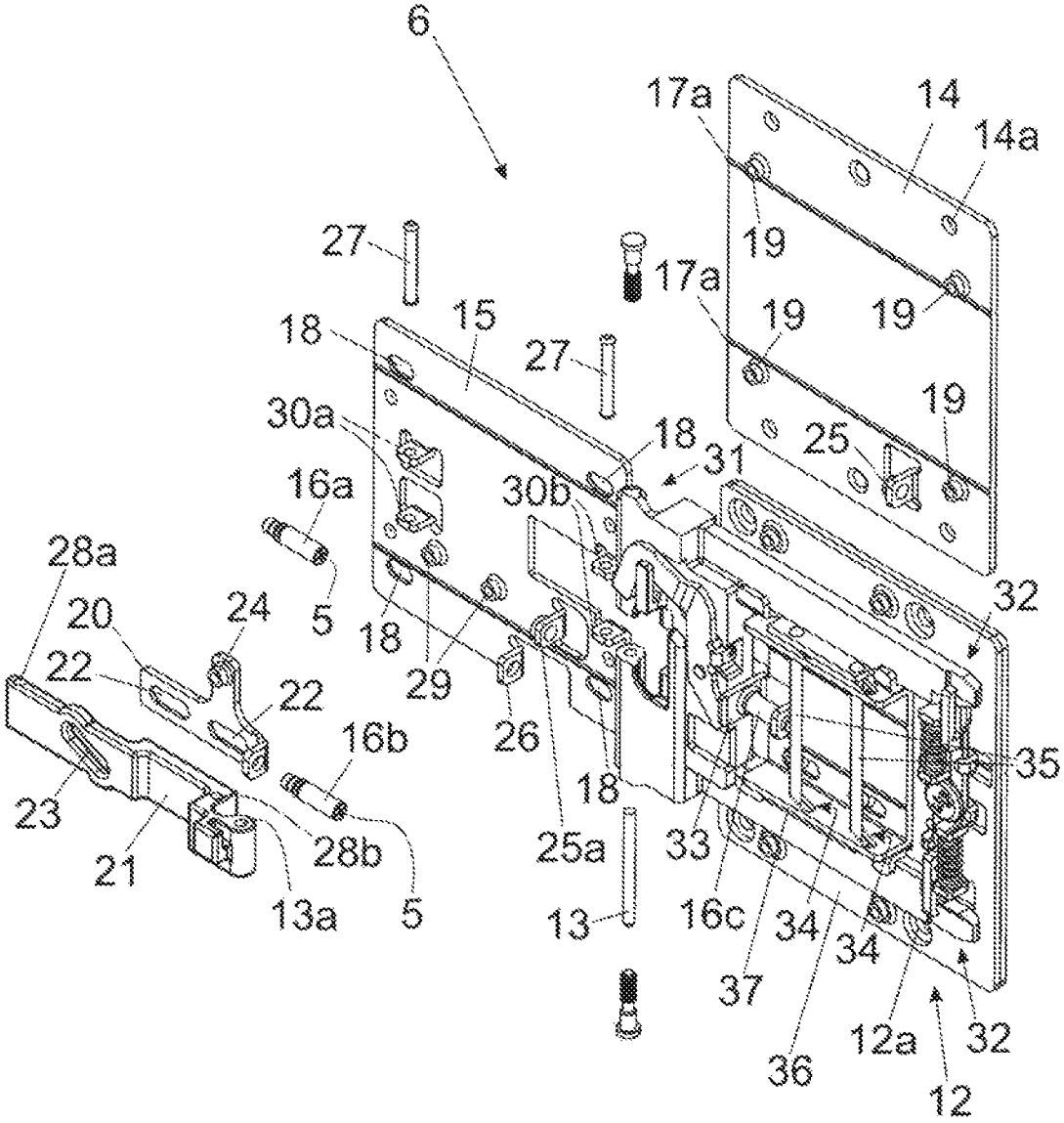
FIG. 5 shows the furniture hinge in an exploded view.

FIG. 5 shows the furniture hinge 6 in an exploded view, in which the fitting portions 11, 12 are connected to one another by at least one hinge axis member 13 in the mounted condition. At least one of the fitting portions 11, 12 includes a base plate 14 to be fixed to one of the furniture parts 3*a*, 3*b* by fastening locations 14*a*. The guide elements 19 of the linear guides 17 engaging the elongated holes 18 of the adjusting plate 15 are arranged on the base plate 14. Moreover, in the shown figure, a further linear guide is provided which includes at least one, preferably two, guiding edge(s) 17*a* formed or arranged on the base plate 14 for the displaceable support of the adjusting plate 15, for example in the form of angled bending edges or embossings of the base plate 14. In addition to the linear guides 17, the adjusting plate 15 can be displaceably guided by the two guiding edges 17*a* of the base plate 14 in the horizontal direction (X) and/or in the vertical direction (Y). A bearing 25 is arranged on the base plate 14 for receiving the first adjustment element 16*a*, and the first adjustment element 16*a* is in threading engagement with a counter-bearing 26 of the adjusting plate 15. Protrusions 29 are arranged on the adjusting plate 15, and the protrusions 29 being configured to cooperate with the guides 22 of the slider 20. The adjusting plate 15 further includes a second bearing 25*a* for receiving the second adjustment element 16*b*, and the second adjustment element 16*b* being in threading engagement with the slider 20. Moreover, holding devices 30*a*, 30*b* for the second linear guides 27 are provided on the adjusting plate 15. By the holding devices 30*a*, 30*b*, the carrier plate 21 can be displaceably supported in a limited manner in the height direction via bores 28*a*, 28*b*. A guide portion 24 is arranged on the slider 20, and the guide portion 24 engages into the transversely extending guide 23 of the carrier plate 21. A bore 13*a* is provided on the carrier plate 21 for receiving the hinge axis member 13.

The second fitting portion 12 includes the base plate 36 to which the guiding rods 35 are fixed. By an actuation of the third adjustment element 16*c*, the adjusting plate 37 is inclinedly adjustable by third linear guides 34 relative to the base plate 36, so that a depth adjustment of the fitting portions 11, 12 in the direction (Z) is produced. The first fitting portion 11 and the second fitting portion 12 can be releasably connected to one another by at least one locking device 32.

For the sake of a compact construction, it is preferably provided that the base plates 14 and 36, the adjusting plates 15 and 37 and the carrier plate 21, and so forth, are in fact configured so as to be plate-shaped. However, this does not mean that the mentioned plates are configured entirely plate-shaped and/or must have a rectangular or a square-shaped circumferential surface.

Each of the first adjustment element 16*a* and/or the second adjustment element 16*b* and/or the third adjustment element 16*c* can have a first end with a tool receiving device 5 for receiving a tool, and a second end spaced from the first end along the longitudinal direction of the adjustment elements 16*a*, 16*b*, 16*c*. The first end of the adjustment elements 16*a*, 16*b*, 16*c* having the tool receiving device 5 is arranged closer to the gap 31 than the second end. This enables easy access to the adjustment elements 16*a*, 16*b*, 16*c* in the mounted position of the furniture hinge 6, and the adjustment elements 16*a*, 16*b*, 16*c* can be actuated by rotating the tool receiving device 5 with the aid of a tool, preferably a screwdriver.

The invention claimed is:

1. A furniture hinge for pivotally connecting a first furniture part to a second furniture part, the furniture hinge comprising:

a first fitting portion to be fixed to the first furniture part;

a hinge axis member;

a second fitting portion to be fixed to the second furniture part, the second fitting portion being pivotally connected to the first fitting portion by the hinge axis member;

wherein at least one of the first fitting portion and the second fitting portion includes:

a base plate to be fixed to one of the first furniture part or the second furniture part, an adjusting plate coupled to the hinge axis member, the adjusting plate being displaceably arranged on the base plate, and an adjustment element configured to be actuated to adjust a position of the adjusting plate relative to the base plate along a linear guide to adjust a position of the first fitting portion relative to the second fitting portion, wherein the furniture hinge is configured such that a gap is formed between the first fitting portion and the second fitting portion in at least one relative position of the furniture hinge to allow introduction of a tool into the gap for actuation of the adjustment element, and wherein the first fitting portion and the second fitting portion are movable relative to each other between a first position in which the first furniture part to be fixed to the first fitting portion and the second furniture part to be fixed to the second fitting portion are aligned parallel to one another, and a second position in which the first furniture part to be fixed to the first fitting portion and the second furniture part to be fixed to the second fitting portion are aligned coplanar to one another.

2. The furniture hinge according to claim 1, wherein the adjustment element is configured to be actuated by the tool introduced into the gap in a relative position of the furniture hinge in which the first fitting portion and the second fitting portion or the first furniture part and the second furniture part connected to the fitting portions, in a mounting condition, adopt an angle of between 0° and 125°.

3. The furniture hinge according to claim 2, wherein the adjustment element can be actuated by the tool introduced into the gap in a relative position of the furniture hinge in which the two fitting portions or the furniture parts connected to the fitting portions adopt an angle of between 0° and 90° relative to one another.

4. The furniture hinge according to claim 1, wherein the adjustment element is pivotally supported about a rotational axis, and wherein the rotational axis of the adjustment element extends transversely relative to the hinge axis member of the furniture hinge.

5. The furniture hinge according to claim 4, wherein the rotational axis of the adjustment element extends at a right angle relative to the hinge axis member of the furniture hinge.

6. The furniture hinge according to claim 1, wherein the adjustment element has a first end with a tool receiving device for receiving a tool, and a second end spaced from the first end in a longitudinal direction of the adjustment element, wherein the adjustment element is arranged such that the first end of the adjustment element is closer to the gap than the second end.

7. The furniture hinge according to claim 1, wherein the linear guide includes an elongated hole arranged on the base plate or on the adjusting plate, wherein a guide element arranged on the adjusting plate or on the base plate is configured to be displaceably guided along the elongated hole.

8. The furniture hinge according to claim 1, wherein the linear guide includes a guiding edge formed or arranged on the base plate for displaceably supporting the adjusting plate.

9. The furniture hinge according to claim 1, wherein one or more linear guides is or are provided so that the adjusting plate is displaceably guided relative to the base plate.

10. The furniture hinge according to claim 1, wherein, by an actuation of the adjustment element, a lateral distance in a direction between the first fitting portion and the second fitting portion is adjustable in a mounted condition of the furniture hinge.

11. The furniture hinge according to claim 1, further comprising a second adjustment element configured to be actuated to adjust a height position in a direction of the first fitting portion relative to the second fitting portion in a mounted condition of the furniture hinge.

12. The furniture hinge according to claim 11, further comprising a carrier plate movably arranged on the adjusting plate, the carrier plate being configured such that by an actuation of the second adjustment element, a height position of the carrier plate relative to the adjusting plate is adjustable in a mounted condition of the furniture hinge.

13. The furniture hinge according to claim 12, wherein the carrier plate includes an inclinedly extending guide along which a movable guide portion can be displaceably guided by an actuation of the second adjustment element.

14. The furniture hinge according to claim 12, wherein the adjusting plate is coupled to the hinge axis member via the carrier plate.

15. The furniture hinge according to claim 11, wherein the second adjustment element is pivotally mounted.

16. The furniture hinge according to claim 11, wherein the first adjustment element has a first rotational axis and the second adjustment element has a second rotational axis, and the direction of the first rotational axis and the direction of the second rotational axis extend substantially parallel to one another.

17. The furniture hinge according to claim 16, wherein a direction of the first rotational axis and a direction of the second rotational axis extend parallel to one another.

18. The furniture hinge according to claim 16, wherein a direction of the first rotational axis and a direction of the second rotational axis extend within an angle of between 0° and 40° relative to a main plane formed by the base plate.

19. The furniture hinge according to claim 11, further comprising a third, adjustment element configured such that a depth position of the first fitting portion relative to the second fitting portion is adjustable by an actuation of the third adjustment element in a mounted condition of the furniture hinge.

20. The furniture hinge according to claim 19, wherein the second adjustment element and/or the third adjustment element is configured to be actuated by introducing a screwdriver into the gap in a mounted condition of the furniture hinge.

21. The furniture hinge according to claim 19, wherein the third adjustment element is pivotally mounted.

22. The furniture hinge according to claim 1, wherein the hinge axis member extends vertically in the mounted condition of the furniture hinge.

23. An arrangement comprising a first furniture part, a second furniture part and the furniture hinge according to claim 1 for pivotally connecting the first furniture part to the second furniture part.

24. The arrangement according to claim 23, wherein each of the first furniture part and the second furniture part is movably supported relative to a furniture carcass in the mounted condition.

25. An item of furniture comprising the arrangement according to claim 23.

26. The furniture hinge according to claim 1, wherein the adjustment element is pivotally mounted.

27. The furniture hinge according to claim 1, wherein the base plate has a bearing for receiving the adjustment element, the adjustment element being in threading engagement with a counter-bearing arranged on the adjusting plate.

* * * * *